US005203304A

United States Patent [19]

Hafner et al.

[11] Patent Number: 5,203,304

[45] Date of Patent: Apr. 20, 1993

[54] FUEL INJECTION SYSTEM FOR INTERNAL COMBUSTION ENGINES

[75] Inventors: Udo Hafner, Ludwigsburg; Ferdinand Reiter, Markgröningen, both of Fed. Rep. of Germany

[73] Assignee: Robert Bosch GmbH, Stuttgart, Fed. Rep. of Germany

[21] Appl. No.: 752,433

[22] PCT Filed: Jan. 10, 1991

[86] PCT No.: PCT/DE91/00015

§ 371 Date: Aug. 19, 1991

§ 102(e) Date: Aug. 19, 1991

[87] PCT Pub. No.: WO91/11608

PCT Pub. Date: Aug. 8, 1991

[30] Foreign Application Priority Data

Jan. 27, 1990 [DE] Fed. Rep. of Germany ..... 4002393

[51] Int. Cl.[5] ..... F02M 55/02; F02M 39/00

[52] U.S. Cl. ..... 123/456; 123/470; 123/468

[58] Field of Search ..... 123/456, 468, 469, 470, 123/472

[56] References Cited

U.S. PATENT DOCUMENTS

| | | | |
|---|---|---|---|
| 4,570,601 | 2/1986 | Ito et al. | 123/468 |
| 4,844,036 | 7/1989 | Bassler et al. | 123/456 |
| 4,860,710 | 8/1989 | Hafner et al. | 123/468 |
| 4,922,880 | 5/1990 | Seibt et al. | 123/470 |
| 4,950,171 | 8/1990 | Muzslay | 123/456 |
| 5,016,594 | 5/1991 | Hafner et al. | 123/456 |
| 5,030,116 | 7/1991 | Sakai et al. | 123/456 |
| 5,058,554 | 10/1991 | Takeda et al. | 123/456 |
| 5,070,844 | 12/1991 | Daly | 123/456 |
| 5,086,743 | 2/1992 | Hickey | 123/456 |

FOREIGN PATENT DOCUMENTS

| | | | |
|---|---|---|---|
| 0163464 | 6/1990 | Japan | 123/468 |

*Primary Examiner*—David A. Okonsky
*Assistant Examiner*—Thomas Moulis
*Attorney, Agent, or Firm*—Edwin E. Greigg; Ronald E. Greigg

[57] ABSTRACT

A fuel injection system for internal combustion engines having a plurality of fuel injection valves of the top-feed type and a fuel distributor, which has a distributor duct formed in a plastic housing and connecting branches, each of which accepts an end-face supply connection of an injection valve. For simplified manufacture and assembly and in order to secure the injection valves against radial twist, electrical plug jacks are integrated in the plastic housing of the fuel distributor to accept corresponding electrical plug elements of the injection valves. Two of the plug jacks are associated in each case with one of the connecting branches in such a way that when the injection valve is pushed into the connecting branch the plug elements simultaneously penetrate into the associated plug jacks. All the plug jacks are electrically connected to a multi-pole connecting plug located on the fuel distributor, and the electronic control unit for controlling the injection valves is connected to the multi-pole connecting plug.

24 Claims, 4 Drawing Sheets

FUEL INJECTION SYSTEM FOR INTERNAL COMBUSTION ENGINES

STATE OF THE ART

Figure 2:
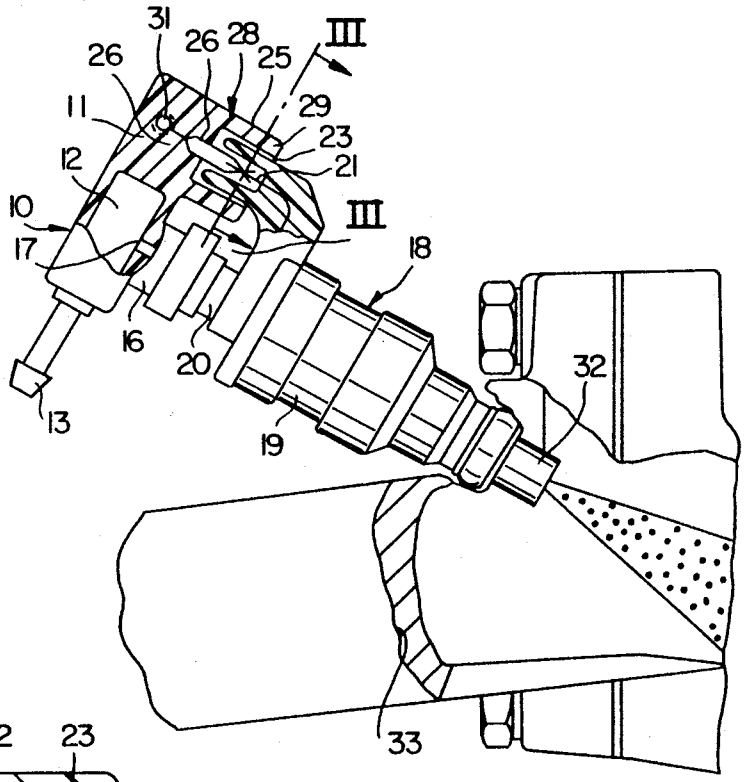

The invention concerns a fuel injection system for internal combustion engines.

In such a fuel injection system, the electromagnetically controlled fuel injection valves are controlled by an electronic control unit as a function of operating parameters of the internal combustion engine, such as induction air quantity, load, temperature, etc., which effect a corresponding metering of the fuel injection quantity. For this purpose, the electrical connections, which are in the form of plug elements protruding from the fuel injection valve housing and which are connected to the electromagnets of the valves, have to be connected to the control unit.

In a known fuel injection system with so-called top-feed injection valves of the type mentioned at the beginning (DE 32 23 556 Al), the electrical contact of the individual fuel injection valves takes place after insertion into the connecting branches of the fuel distributor by means of individual plugs which are pushed onto each fuel injection valve. This implies a substantial effort to fit the fuel distributor to the internal combustion engine because all the plugs have to be pushed on individually after the fuel distributor equipped with the fuel injection valves has been fastened on.

A fuel injection system with a fuel distributor and fuel injection valves of the so-called side-feed type is already known (DE 37 30 571 A1), in which the fuel injection valves are inserted in stepped acceptance holes of a base body, the acceptance holes being open in the axial direction and connected to the distributor duct. The two electrical plug elements per fuel injection valve for connecting the electromagnet to the control unit are located on each fuel injection valve on the end face of the valve housing opposite to the injection mouthpiece and there protrude axially from the valve housing. All the fuel injection valves are, on the one hand, fixed in the acceptance holes by a contact strip in plastic placed on the base body and fastened to it and, on the other hand, are provided with electrical contact, for which purpose the contact strip has a number of integrated electrical plugs corresponding to the number of fuel injection valves. The plugs are individually connected to a connection plug by means of electrical connecting conductors extending in the contact strip; the connection plug is located to the side on the contact strip and the individual fuel injection valves are connected to the control unit by means of this connection plug. This constructional design of the fuel injection system has the double advantage that the fitting time on the internal combustion engine is substantially reduced and that a saving in material costs is achieved because many individual plugs, cables, clamps, etc. become unnecessary. In addition, the basic body and the inserted fuel injection valves, which are provided with electrical contact and are mechanically held by means of the contact strip, form a compact structural unit which permits functional and leak testing and, immediately afterwards, fitting to the induction pipes of the internal combustion engine in a condition unaltered relative to the testing.

ADVANTAGES OF THE INVENTION

The fuel injection system according to the invention has the advantage that even in the case of fuel injection systems with so-called top-feed valves, in which the plug elements protrude to the side of the valve casing because the fuel is supplied at the end, the fuel distributor and fuel injection valves can be combined into a compact structural unit which can be finally tested for function, jet direction and leaks and, after testing, can be fitted immediately and without change relative to the test condition onto the internal combustion engine. The fitting effort on site is therefore substantially less. Because the electrical contacts of the plug elements are made simultaneously on insertion of the fuel injection valves in the fuel distributor, the fuel injection valves are mechanically secured against radial twist. After insertion and testing during fitting to the internal combustion engine, therefore, the fuel injection valves can no longer twist, so that the jet direction of the injection jet which has been set is reliably maintained. Particularly in the case of multi-jet injection valves, whose jet direction has to be accurately set and reliably maintained, this is of great importance. The direct integration of the plugs in the plastic housing of the fuel distributor not only replaces a separate plastic rail but also accelerates the fitting procedure because the insertion of the fuel injection valve in the connecting branch takes place simultaneously with the making of the electrical plug connection.

Advantageous extensions and improvements to the fuel injection system given herein are possible by means of the measures listed hereinafter.

DRAWING

Figure 3:
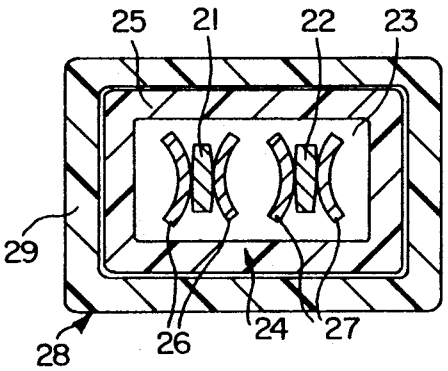
Figure 1:
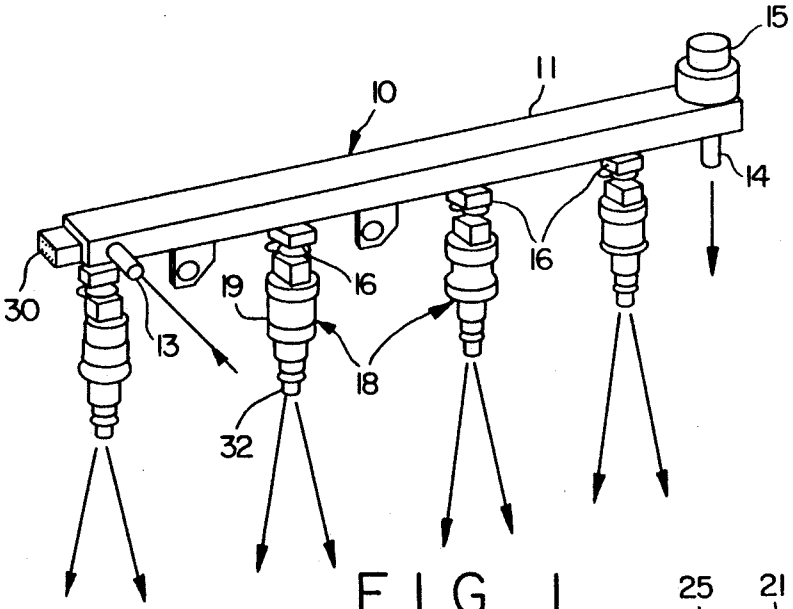
Figure 4:
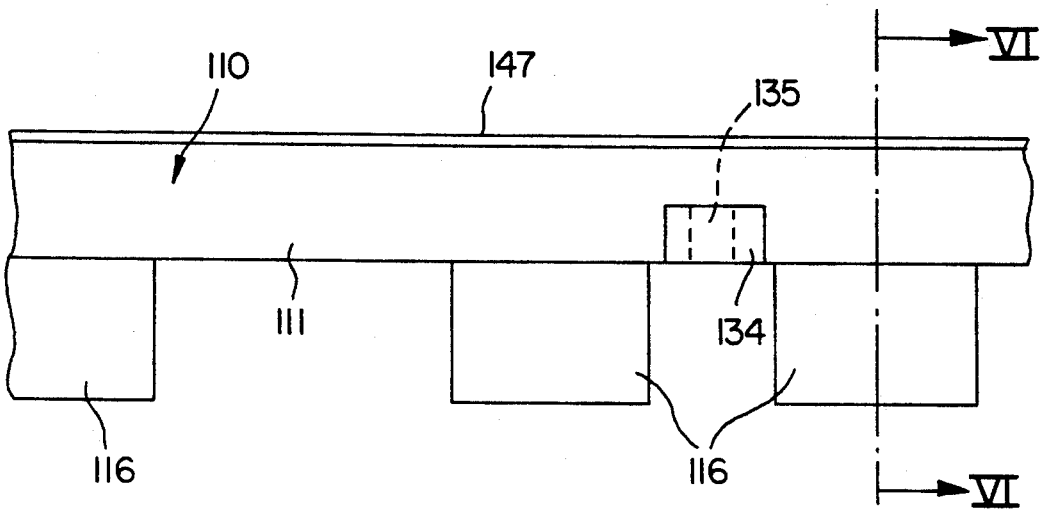
Figure 5:
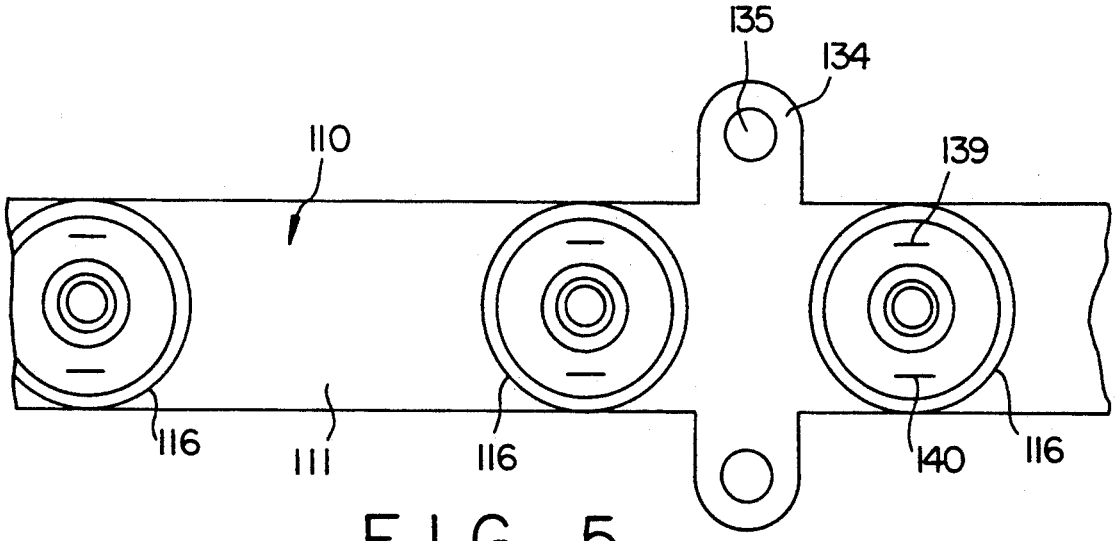
Figure 6:
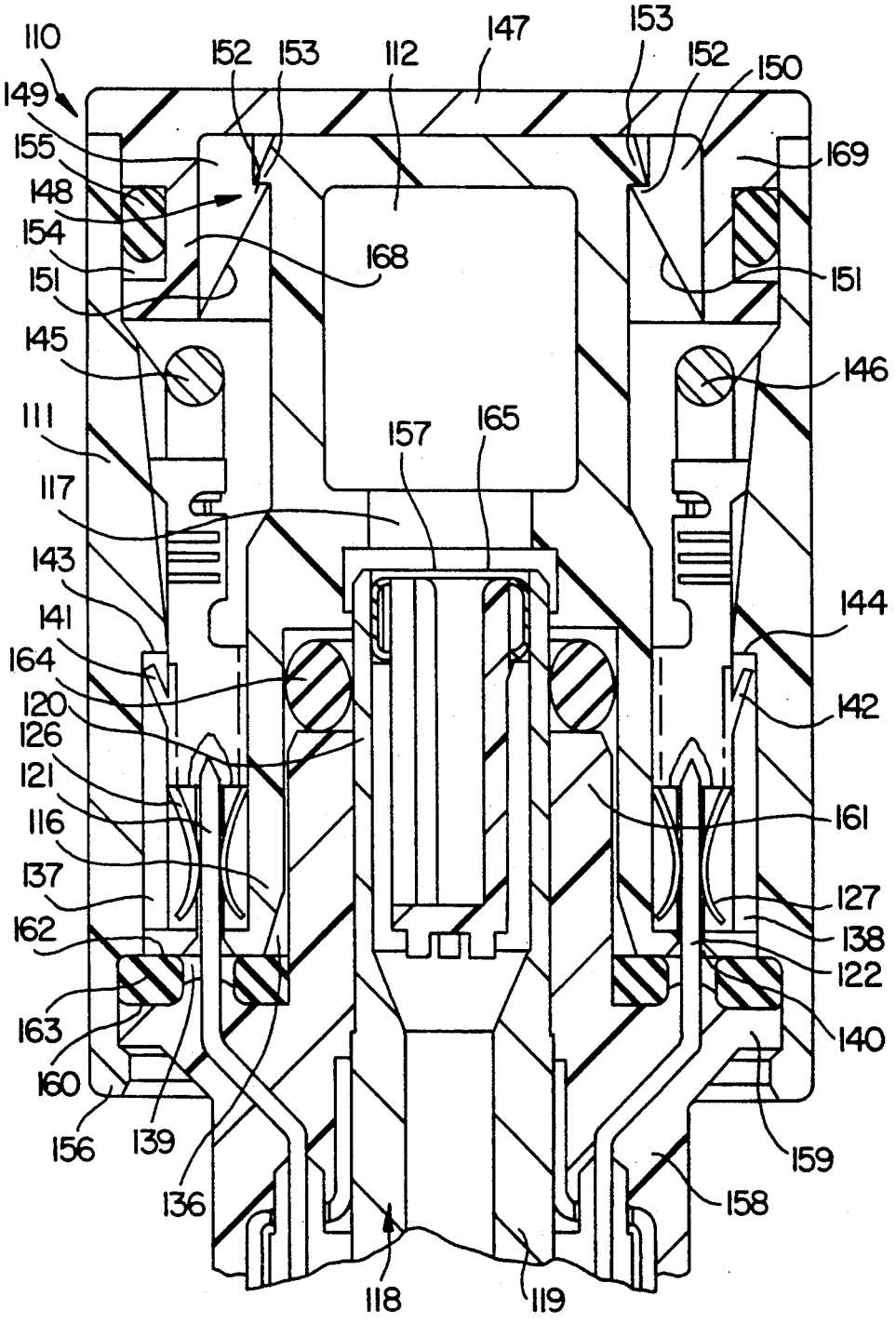
Figure 7:
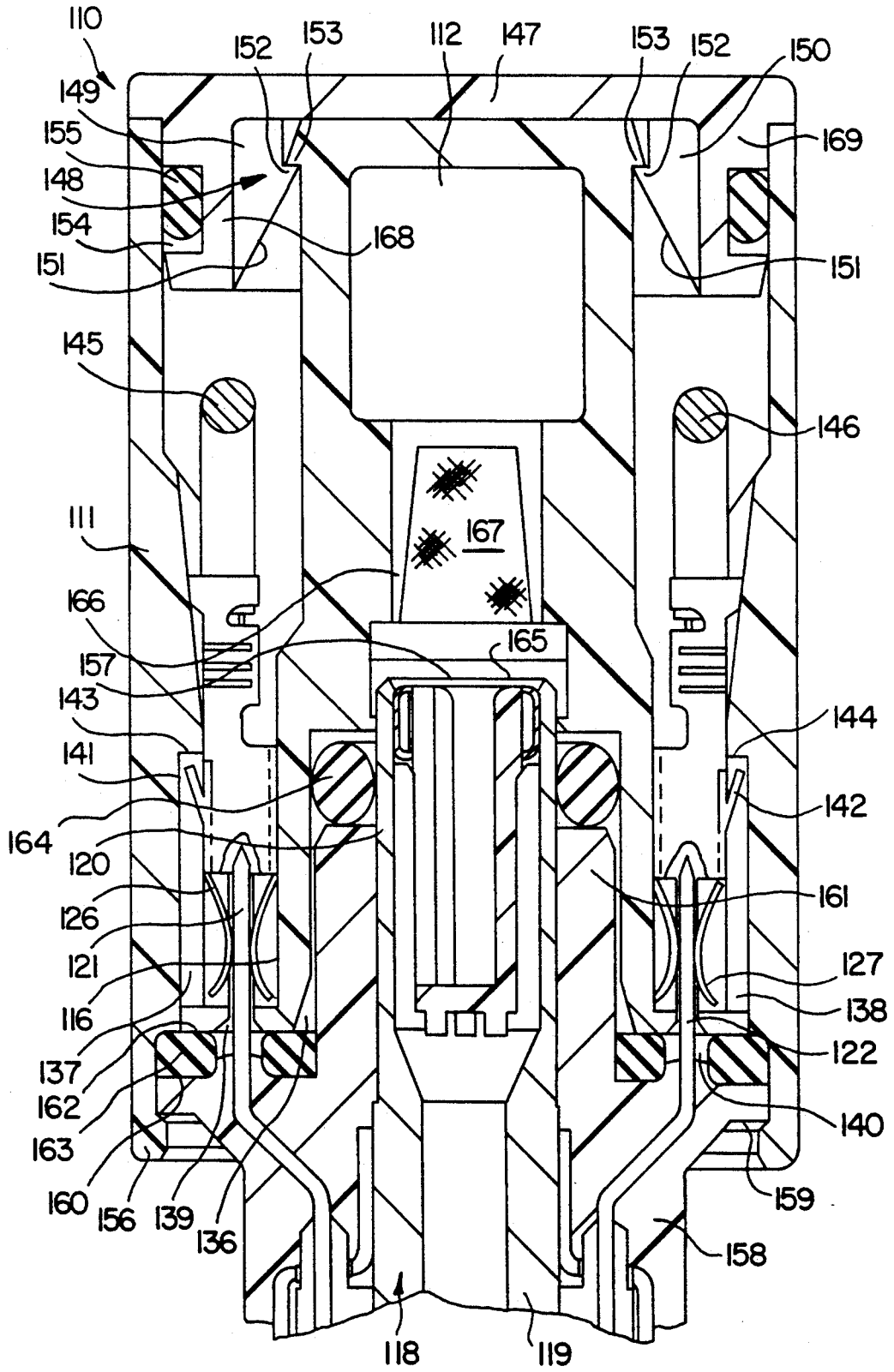

The invention is explained in more detail in the following description using the illustrative examples shown in the drawing. In this:

FIG. 1 shows a perspective representation of a fuel distributor with fuel injection valves of a fuel injection system for an internal combustion engine inserted in it, FIG. 2 shows a partial cross-section of the fuel distributor in FIG. 1 with a diagrammatically indicated induction pipe of the internal combustion engine, FIG. 3 shows a section along the line III—III in FIG. 2, to a larger scale, FIG. 4 shows an excerpt of a side view of a fuel distributor according to a further illustrative example, FIG. 5 shows an excerpt of a bottom view of the fuel distributor in FIG. 4, FIG. 6 shows a section along the line VI—VI in FIG. 4 with a fuel injection valve inserted in the fuel distributor, FIG. 7 shows a similar representation to that in FIG. 6, for a modified fuel distributor.

DESCRIPTION OF THE ILLUSTRATIVE EXAMPLE

The fuel injection system, shown only partially in FIG. 1, for an internal combustion engine has a fuel distributor 10 in whose plastic housing 11 is formed a distributor duct 12 (See FIG. 2) which emerges at the ends of the plastic housing 11 in a connecting mouthpiece 13 for the fuel supply and in a connecting mouthpiece 14 for the fuel drain. The connecting mouthpiece 13 is connected via a fuel supply conduit to a fuel pump (not shown) which pumps fuel from a fuel tank. The mouthpiece 14 is connected via a return line (again not shown) to the fuel tank. A pressure control valve 15, which regulates the fuel pressure in the distributor duct 12 to a specified value, is located between the connecting mouthpiece 14 and the emergence of the distributor duct 12 in the connecting mouthpiece 14. On its lower surface, the plastic housing 11 carries four connecting branches 16, each of which is connected to the distributor duct 12 by means of an outlet opening 17 (FIG. 2). The number of connecting branches 16 is equal to the number of combustion cylinders in the internal combustion engine.

Corresponding to the number of combustion cylinders in the internal combustion engine, the fuel injection system also has four fuel injection valves 18 of the so-called top-feed type. Each of these electromagnetically operable fuel injection valves 18 has a valve housing 19, at one end of which is formed a supply connection 20 which has a fuel supply opening emerging at its free end surface. Each fuel injection valve 18 is inserted in a liquid-tight manner by means of this supply connection 20 into a connecting branch 16 on the lower surface of the fuel distributor 10, the fuel supply opening in the supply connection 20 being connected to the distributor duct 12 via the outlet opening 17 in the connecting branch 16. For valve operation, each of the fuel injection valves 18 has an electromagnet (not visible here) whose electricity supply takes place via two electrical plug elements 21, 22 which protrude to the side near the supply connection 20 on the valve housing 19. As may be seen from FIGS. 2 and 3, the plug elements 21, 22 have a rectangular cross-section and are combined in a plug socket 23 fastened to the valve housing 19. This plug socket 23 is formed in an angular plastic part 24 which encloses a section of the supply connection 20 and is positively held against radial twist on the latter. The plug socket 23 is integrated at its end in the angled region of the plastic part 24, a collar 25 integral with the plastic part 24 surrounding, at a distance, the plug elements 21, 22 protruding from the angled section of the plastic 24 and extending parallel to the valve axis, and protruding axially beyond the plug elements 21, 22.

Integrated in the plastic housing 11 of the fuel distributor 10 are a number of electrical plug jacks 26, 27 which are designed for corresponding acceptance of the plug elements 21, 22. Two plug jacks 26, 27 are spatially allocated to each connecting branch 16 in such a way that when the supply connection 20 of a fuel injection valve 18 is pushed into the connecting branch 16, the plug elements 21, 22 simultaneously penetrate into the associated plug jacks 26, 27. As may be seen from FIGS. 2 and 3, two plug jacks 26, 27 are united in each case to form a plug 28 integral with the plastic housing 11, which plug 28, on penetration of the plug elements 21, 22 into the plug jacks 26, 27, is pushed with a hood 29 over the collar 25 of the plug socket 23. This hood 29, which is integral with the plastic housing 11, surrounds at a distance the plug jacks 26, 27 protruding transverse to the axis of the fuel distributor 10 on the lower surface of the plastic housing 11 and protrudes beyond the end of the plug jacks 26, 27. The distance is selected in such a way that on penetration of the plug elements 21, 22 into the plug jacks 26, 27, the collar 25 of the plug socket 23 can be pushed in between the plug jacks 26, 27 and the hood 29. The positive connection between the plug elements 21, 22 and the plug jacks 26, 27, on the one hand, and the positive connection between the collar 25 and the hood 29, on the other, ensure that each fuel injection valve 18 can only be inserted in a certain rotational position in the associated connecting branch 16 of the fuel distributor 10 and that, after insertion, radial twist of the inserted fuel injection valve 18 is reliably prevented. The direction of the fuel injection jet relative to the axis of the fuel injection valve 18 is therefore unalterably fixed once it has been set.

All the plug jacks 26, 27 are individually connected to a multi-pole connecting plug 30 by means of an electrical connecting cable extending in the plastic housing 11 of the fuel distributor 10, the connecting plug 30 being fastened to one end face of the plastic housing 11. Of the individual connecting cables, only one connecting cable 31, which leads to one plug jack 26, can be seen in FIG. 2. The electronic control unit for controlling the fuel injection valves 18 is connected to the connecting plug 30 via a multi-core cable. There are two possibilities for controlling the fuel injection valves 18. In the first case, each fuel injection valve 18 is individually controlled by the control electronics so that a corresponding number of electrical control lines are run via the connecting plug 30 between the control unit and the four fuel injection valves 18. In the second case, all the fuel injection valves 18 are controlled simultaneously. In consequence, only two electrical control lines are necessary.

The fuel distributor 10, with the fuel injection valves 18 inserted in it, can be fitted to the internal combustion engine as a completely prefabricated and finally tested constructional unit, each of the injection openings 32 of the fuel injection valves 18 protruding into an induction pipe 33 of the internal combustion engine, as represented diagrammatically in FIG. 2.

A further illustrative example of a fuel distributor 110 is shown in FIGS. 4–6. The distributor duct 112 (FIG. 6) is again formed in the plastic housing 111 and this distributor duct 112 is connected to several connecting branches 116 via outlet openings 117. The rotationally symmetrical connecting branches 116 are formed integrally on the elongated box-shaped plastic housing 111 and protrude from its lower surface (FIGS. 4 and 5). Lugs 134 with fastening holes 135, formed on the plastic housing 111, are used for fastening the completely preassembled fuel distributor 110 to the internal combustion engine.

In each connecting branch 116, near the insertion opening 136 for the supply connections 120 of the fuel injection valves 118 there are two mutually diametrically arranged pockets 137, 138 which pass through the connecting branch 116 of the plastic housing 111 and are open towards the upper surface of the plastic housing 111 facing away from the connecting branches 116. On their lower surface facing towards the insertion opening 136 for the supply connections 120, the pockets 137, 138 are each provided with a slot 139, 140 which is designed in such a way that an electrical plug element 121 or 122 on the fuel injection valve 118 can penetrate through. A plug jack 126, 127 is pushed into each pocket 137 or 138 coaxially to the slot 139 or 140 and is secured in the bottom part of the pocket against axial displacement by means of a catch. For this purpose, the plug jack 126 or 127 has, on its one rear face, a spring tongue 141 or 142 which engages behind a catch nose 143 or 144 in the pocket 137, 138. The end of the plug jack 126 or 127 facing away from the slot 139 or 140 is connected to a connecting conductor 145 or 146 which, like the connecting cable 31 in FIG. 2, leads to a connecting plug provided on the side of the plastic housing 111. On the upper surface, the pockets 137 and 138 are covered by a cover rail 147 which is clipped into the plastic housing 111 by means of catches 148 provided on the upper surface of the pockets on the plastic housing 111. Each catch 148 consists of two opposite catch ribs 149, 150 which protrude from side webs 168, 169 of the cover rail 147 projecting into the pockets 137, 138 and which each have, in conventional manner, an insertion chamfer 151 and a catch protrusion 152. By means of this catch protrusion 152, the catch ribs 149, 150 engage behind corresponding protrusions 153 on the opposite pocket wall. A groove 154, in each of which is inserted a seal 155, is provided in each longitudinally extending web 168, 169 of the cover rail 147 for protection against spray water.

On its end having the insertion opening 136 for the supply connection 120 of the fuel injection valves 118, each connecting branch 116 carries an axially protruding catch collar 156 for the mechanical locking of the fuel injection valve 118 inserted in the insertion opening 136.

Each electromagnetic fuel injection valve 118 of the so-called top-feed type has, as usual, a valve housing 119 with a supply connection 120 which is formed at the one end and has a fuel supply opening 157 emerging at its free end. A plastic hood 158 coaxially surrounding the supply connection 120 with a hub-type protrusion 161 is permanently seated on the end of the valve housing 119, this plastic hood 158 carrying a radially projecting locking flange 159. The two plug elements 121, 122 emerge freely from the annular surface 160 of the locking flange 159 facing towards the supply connection 120 and extend diametrically to one another parallel to and at a distance from the supply connection 120. Each plug element 121, 122 is, as usual, in electrically conducting connection with one winding end of an exciter winding of an electromagnet for valve actuation. During assembly, the fuel injection valve 118 with its supply connection 120 and the hub-type protrusion 161 of the plastic hood 158 surrounding it is pushed into the insertion opening 136 in the connecting branch 116, the two plug elements 121, 122 penetrating through the slots 139, 140 in the annular surface 162, surrounding the insertion opening 136, on the connecting branch 116 and being pushed into the associated plug jacks 126, 127. At the end of the push-in motion, the catch collar 156 engages behind the locking flange 159 and secures the fuel injection valve 118, torsionally held in the connecting branch 116 by the plug elements 121, 122 and plug jacks 126, 127, against unwanted axial displacement. An annular flat seal 163 is placed in between the annular surface 160 on the locking flange 159 and the annular surface 162 on the connecting branch 116 for protection against spray water. An O-ring seal 164 seated on the end surface of the hub-type protrusion 161 of the plastic hood 158 and surrounding the supply connection 120 prevents the emergence of fuel from the connecting branch 116. A filter basket 165 is inserted in each supply connection 120 to protect the fuel injection valves 118 from dirt particles in the fuel.

The modified fuel distributor 110' shown in cross-section in FIG. 7 differs from the fuel distributor 110 shown in FIG. 6, and described above, only in that a filter duct 166 is located parallel to the distributor duct 112, a replaceable filter 167 being laid in it. By this means, the insertion of filter baskets 165 in each individual supply connection 120 of the fuel injection valves 118 becomes necessary. Otherwise, all the components of the fuel distributor 110' in FIG. 7 agree with the components of the fuel distributor 110 in FIG. 6 so the insertion of the reference signs has been omitted.

We claim:

1. A fuel injection system for internal combustion engines, having a plurality of electromagnetically operable fuel injection valves of the top-feed type in combination with a fuel distributor which has a distributor housing duct formed along a length of the fuel distributor housing, comprising a valve housing with a supply connection (120) having an end-face fuel supply opening and, for valve control, two electrical plug connection elements (121, 122) which protrude axially from the valve housing and extend at a parallel distance from one another on diametrical sides of the supply connection (120), said fuel distributor housing begins with a fuel supply and ends with a fuel drain and includes a number of connecting branches (116) which correspond to the plurality of fuel injection valves, said connecting branches (116) are integral with the fuel distributor housing and connected via outlet openings with the distributor duct, said valve housings are inserted into said connecting branches in a fluid-tight manner with the supply connections (120) of the fuel injection valves in alignment with said outlet openings, said electrical plug jacks (126, 127) are integrated with the fuel distributor housing and designed for corresponding acceptance of the electrical plug connection elements (121, 122) and, in each case, two of the plug jacks (126, 127) are allocated to a connecting branch (116) in the fuel distributor housing in such a way that when the supply connection (120) is pushed into an insertion opening (136) of the connecting branch (116), the electrical plug connection elements (121, 122) also penetrate into the associated plug jacks (126, 127), and in which each connecting branch (116) includes two separate pockets (137, 138) located near the insertion opening (136) for the supply connections (120) of the fuel injection valves (118) in which the plug jacks (126, 127) each of which is connected to a connecting conductor (145, 146) is accommodated.

2. An injection system according to claim 1 in which each of the pockets (137, 138) opens toward its upper surface facing away from the connecting branches (116) and is sealed by a longitudinally continuous cover rail (147) clipped onto the housing.

3. An injection system according to claim 1 in which each of the pockets (137, 138) has a slot (139, 140) on their bottom surface, facing towards the insertion opening (136) for the supply connections (120), for the penetration of a plug element (121, 122) which penetrates transverse to the longitudinal axis of the fuel distributor housing.

4. An injection system according to claim 3, in which each connecting branch (116) carries an axially protruding catch collar (156) on its end having the insertion opening (136) for the supply connection (120) of the fuel injection valves (118), which catch collar (156) engages behind a locking flange (159) on the supply connection (120) of the fuel injection valves (118).

5. An injection system according to claim 3, which includes a dirt filter basket (165) inserted in each supply connection (120) of the fuel injection valves (118).

6. An injection system according to claim 3, in which a longitudinally continuous filter duct (166) extends parallel to the distributor duct (112) between the distributor duct (112) and the outlet openings (117) of the connecting branches (116) and is in connection with both connecting branches, and a replacement filter (167) is located in the filter duct (166).

7. An injection system according to claim 3, in which a seal (155) is laid between the side walls of the plastic housing (11) and engagement webs (168, 169) of a cover rail (147) penetrates into plastic housing (11).

8. An injection system according to claim 7, in which each connecting branch (116) carries an axially protruding catch collar (156) on its end having the insertion opening (136) for the supply connection (120) of the fuel injection valves (118), which catch collar (156) engages behind a locking flange (159) on the supply connection (120) of the fuel injection valves (118).

9. An injection system according to claim 7, which includes a dirt filter basket (165) inserted in each supply connection (120) of the fuel injection valves (118).

10. An injection system according to claim 7, in which a longitudinally continuous filter duct (166) extends parallel to the distributor duct (112) between the distributor duct (112) and the outlet openings (117) of the connecting branches (116) and is in connection with both connecting branches, and a replacement filter (167) is located in the filter duct (16).

11. An injection system according to claim 3, which include catch noses (143, 144), and in order to lock the plug jacks (126, 127) against axial displacement, the plug jacks (126, 127) have spring tongues (141, 142) which, after the plug jacks (126, 127) have been pushed into the pockets (137, 138), engage behind the catch noses (143, 144).

12. An injection system according to claim 11, in which each connecting branch (116) carries an axially protruding catch collar (156) on its end having the insertion opening (136) for the supply connection (120) of the fuel injection valves (118), which catch collar (156) engages behind a locking flange (159) on the supply connection (120) of the fuel injection valves (118).

13. An injection system according to claim 11, which includes a dirt filter basket (165) inserted in each supply connection (120) of the fuel injection valves (118).

14. An injection system according to claim 11, in which a longitudinally continuous filter duct (166) extends parallel to the distributor duct (112) between the distributor duct (112) and the outlet openings (117) of the connecting branches (116) and is in connection with both connecting branches, and a replacement filter (167) is located in the filter duct (166).

15. An injection system according to claim 11, in which a seal (155) is laid between the side walls of the plastic housing (11) and engagement webs (168, 169) of a cover rail (147) penetrates into the plastic housing (11).

16. An injection system according to claim 15, in which each connecting branch (116) carries an axially protruding catch collar (156) on its end having the insertion opening (136) for the supply connection (120) of the fuel injection valves (118), which catch collar (156) engages behind a locking flange (159) on the supply connection (120) of the fuel injection valves (118).

17. A fuel injection system for internal combustion engines, having a plurality of electromagnetically operable fuel injection valves of the top-feed type in combination with a fuel distributor housing which has a distributor duct formed along a length of the fuel distributor housing, comprising a valve housing with a supply connection (120) having an end-face fuel supply opening and, for valve control, two electrical plug connection elements (121, 122) which protrude axially from the valve housing and extend at a parallel distance from one another on diametrical sides of the supply connection (120), said fuel distributor housing begins with a fuel supply and ends with a fuel drain and includes a number of connecting branches (116) which correspond to the plurality of fuel injection valves, said connecting branches (116) are integral with the fuel distributor housing and connected via outlet openings with the distributor duct, said valve housings are inserted into said connecting branches in a fluid-tight manner with the supply connections (120) of the fuel injection valves in alignment with said outlet opening, said electrical plug jacks (126, 127) are integrated with the fuel distributor housing (111) and designed for corresponding acceptance of the electrical plug connection elements (121, 122) and, in each case, two of the plug jacks (126, 127) are allocated to a connecting branch (116) in the fuel distributor housing (111) in such a way that when the supply connection (120) is pushed into an insertion opening (136) of the connecting branch (116), the electrical plug connection elements (121, 122) also penetrate into the associated plug jacks (126, 127), in which each connecting branch (116) includes two separate pockets (137, 138) located near the insertion opening (136) for the supply connections (120) of the fuel injection valves (118) in which the plug jacks (126, 127) each of which is connected to a connecting conductor (145, 146) is accommodated, and each connecting branch (116) carries an axially protruding catch collar (156) on its end having the insertion opening (136) for the supply connection (120) of the fuel injection valves (118), which catch collar (156) engages behind a locking flange (159) on the supply connection (120) of the fuel injection valves (118).

18. An injection system according to claim 17, which includes a dirt filter basket (165) inserted in each supply connection (120) of the fuel injection valves (118).

19. An injection system according to claim 17, in which a longitudinally continuous filter duct (166) extends parallel to the distributor duct (112) between the distributor duct (112) and the outlet openings (117) of the connecting branches (116) and is in connection with both connecting branches, and a replacement filter (167) is located in the filter duct (166).

20. An injection system according to claim 17, in which a flat annular seal (163) is laid between an end annular surface (16) of the locking flange (159) and an annular surface (162) of the connecting branch (116) having slots (139, 140) concentrically surrounds the insertion opening (136) for the supply connection (120).

21. An injection system according to claim 20, which includes a dirt filter basket (165) inserted in each supply connection (120) of the fuel injection valves (118).

22. An injection system according to claim 20, in which a longitudinally continuous filter duct (166) extends parallel to the distributor duct (112) between the distributor duct (112) and the outlet openings (117) of the connecting branches (116) and is in connection with both connecting branches, and a replacement filter (167) is located in the filter duct (166).

23. A fuel injection system for internal combustion engines, having a plurality of electromagnetically operable fuel injection valves of the top-feed type in combination with a fuel distributor housing which has a distributor duct formed along a length of the fuel distributor housing, comprising a valve housing with a supply connection (120) having an end-face fuel supply opening and, for valve control, two electrical plug connection elements (121, 122) which protrude axially from the valve housing and extend at a parallel distance from one another on diametrical sides of the supply connection (120), said fuel distributor housing begins with a fuel supply and ends with a fuel drain and includes a number of connecting branches (116) which correspond to the plurality of fuel injection valves, said connecting branches (116) are integral with the fuel distributor housing and connected via outlet openings with the distributor duct, said valve housings are inserted into said connecting branches in a fluid-tight manner with the supply connections (120) of the fuel injection valves in alignment with said outlet opening, said electrical plug jacks (126, 127) are integrated with the fuel distributor housing (111) and designed for corresponding acceptance of the electrical plug connection elements (121, 122) and, in each case, two of the plug jacks (126, 127) are allocated to a connecting branch (116) in the fuel distributor housing (111) in such a way that when the supply connection (120) is pushed into an insertion opening (136) of the connecting branch (116), the electrical plug connection elements (121, 122) also penetrate into the associated plug jacks (126, 127), in which each connecting branch (116) includes two separate pockets (167, 138) located near the insertion opening (136) for the supply connection (120) of the fuel injection valves (118) in which the plug jacks (126, 127) each of which is connected to a connecting conductor (145, 146) is accommodated, and a dirt filter basket (165) inserted in each supply connection (120) of the fuel injection valves (118).

24. A fuel injection system for internal combustion engines, having a plurality of electromagnetically operable fuel injection valves of the top-feed type in combination with a fuel distributor housing which has a distributor duct formed along a length of the fuel distributor housing, comprising a valve housing with a supply connection (120) having an end-face fuel supply opening and, for valve control, two electrical plug connection elements (121, 122) which protrude axially from the valve housing and extend at a parallel distance from one another on diametrical sides of the supply connection (120), said fuel distributor housing begins with a fuel supply and ends with a fuel drain and includes a number of connecting branches (116) which correspond to the plurality of fuel injection valves, said connecting branches (116) are integral with the fuel distributor housing and connected via outlet openings with the distributor duct, said valve housings are inserted into said connecting branches in a fluid-tight manner with the supply connections (120) of the fuel injection valves in alignment with said outlet opening, said electrical plug jacks (126, 127) are integrated with the fuel distributor housing (111) and designed for corresponding acceptance of the electrical plug connection elements (121, 122) and, in each case, two of the plug jacks (126, 127) are allocated to a connecting branch (116) in the fuel distributor housing (111) in such a way that when the supply connection (120) is pushed into an insertion opening (136) of the connecting branch (116), the electrical plug connection elements (121, 122) also penetrate into the associated plug jacks (126, 127), in which each connecting branch (116) includes two separate pockets (137, 138) located near the insertion opening (136) for the supply connections (120) of the fuel injection valves (118) in which the plug jacks (126, 127) each of which is connected to a connecting conductor (145, 146) is accommodated, and a longitudinally continuous filter duct (166) extends parallel to the distributor duct (112) between the distributor duct (112) and the outlet openings (117) of the connecting branches (116) and is in connection with both connecting branches, and a replacement filter (167) is located in the filter duct (166).

* * * * *